US005492616A

United States Patent [19]

Cook et al.

[11] Patent Number: 5,492,616

[45] Date of Patent: Feb. 20, 1996

[54] PROTECTIVE ENVELOPE PACKAGE

[75] Inventors: Sanford L. Cook, Ocean; Joseph N. Villa, Hazlet; Bruce B. Sawyer, Piscataway; Kenneth Gibbs, Martinsville, all of N.J.

[73] Assignee: C&C Manufacturng Ltd./Johnson & Johnson, Dunellen, N.J.

[21] Appl. No.: 304,890

[22] Filed: Sep. 13, 1994

[51] Int. Cl.[6] ..... B65B 81/03

[52] U.S. Cl. ..... 206/591; 220/4.23; 229/87.02; 229/92

[58] Field of Search ..... 206/521, 587, 206/588, 591, 592, 594; 220/4.23; 229/87.02, 92

[56] References Cited

U.S. PATENT DOCUMENTS

| | | | |
|---|---|---|---|
| 1,821,668 | 9/1931 | Ross . | |
| 3,361,322 | 11/1968 | Gabriel et al. | 206/521 |
| 4,235,345 | 11/1980 | Vande Drink et al. . | |
| 4,784,267 | 11/1988 | Gessler et al. . | |
| 4,938,360 | 7/1990 | Wallace | 206/594 X |
| 5,090,570 | 2/1992 | Todd | 206/521 X |
| 5,156,267 | 10/1992 | Yates, Jr. et al. | 220/4.23 X |
| 5,183,159 | 2/1993 | Hojnacki et al. | 206/591 X |

FOREIGN PATENT DOCUMENTS 2815046 11/1978 Germany .

*Primary Examiner*—Jacob K. Ackun
*Attorney, Agent, or Firm*—Jonathan B. Schafrann

[57] ABSTRACT

A protective envelope package is formed by folding an essentially flat blank along a midpoint and hinge area to form an essentially flat first panel and flat second panel. Upstanding from and along the top and bottom peripheral edges of the flat first panel are a plurality of annular receptacles. Upstanding from and along the top and bottom peripheral edges of the flat second panel are a like number of upstanding locking members, said upstanding locking members being adapted to engage said annular receptacles to maintain the envelope in a folded condition. A plurality of ribs disposed in a longitudinal and parallel conformation on the panels prevent compression of the flat first panel and flat second panel. The envelope package my be opened by exerting force downward on its peripheral edges so that the object retained therein is expelled without the user actually handling the object.

69 Claims, 4 Drawing Sheets

PROTECTIVE ENVELOPE PACKAGE

FIELD OF THE INVENTION

The present invention generally relates to packages and more specifically to a protective envelope package for shipping labile objects.

BACKGROUND OF THE INVENTION

There are many types of insulation and packaging materials to transport payloads which are prone to breakage. As well, there have been a multitude of containers fashioned from exotic composite materials and from such plebeian materials as cardboard to transport payloads which are unstable or fragile. Notwithstanding the material, the result has often been an ungainly package which is many times greater in size than the object which is contained within. In fact, in order to insure the requisite amount of protection, a relatively small object must be surrounded by great amounts of packing materials. The Post Office or other carrier must be process each package by hand.

Despite their inherent memory qualities, most polymer materials, are labile to cracking or deforming when exposed to common handling techniques. Heretofore, there is no available package design that incorporates small size with resistance to repeated bending and handling pressures.

Materials such as corrugated cardboard in conjunction with plastic "bubble wrap" or foam beads, peanuts or the like seem to be the state of the art for protecting fragile objects.

The prior art is simply devoid of a package for mailing labile objects utilizing a mailer of traditional dimensions.

Prior Art

While the prior art discloses a wide variety of actual packaging materials for use within a box or container there have been few prior art examples of foldable packages. Set out below are the closest examples of containers which are foldedly constructed.

U.S. Pat. No. 1,915,620 issued to Rowland discloses a package that has a number of foldable flanged members which cooperate to form a package for papers or other flat objects.

U.S. Pat. No. 4,235,345 issued to VandeDrink et al discloses a packaging case which is designed to transport a plurality of cartons containing fluids. The walls remain rigid and in the assembled condition, the crate has four rigid walls and handle means therein.

OBJECTS AND SUMMARY OF THE INVENTION

The principle object of the present invention is to provide a package that will house a fragile object and retain the same during transport or mailing without using bulky packaging materials.

Another object of the invention to provide an envelope-type package which is adapted to be processed through the existing Post Office machinery by providing an envelope package which is inherently flexible and defies repeated bending without deforming, breaking or opening.

Yet another object of the invention is to furnish a package which is essentially flat and conforms in overall size and dimensions to a standard envelope while providing heightened protection for the object contained therein.

A further object of the present invention is to provide an envelope package where the object contained therein can be ejected and the package emptied without the intended recipient manually manipulating or otherwise touching the object.

SUMMARY OF THE INVENTION

The envelope package is formed from a flat blank which is foldable along a midline so that there is a first flat panel and a second flat panel. Upstanding from the first panel is a plurality of annular receptacles. The annular receptacles are disposed along the upper and lower peripheral edges of the flat first panel member and a like number of upstanding locking members are disposed in corresponding relation along the peripheral edges of the flat second panel member.

Each annular cavity is adapted to receive the upstanding locking member. The annular cavity and the upstanding locking member have similar shapes and geometry. The design of each annular cavity provides for an area which closely approximates the width of the flared base of the upstanding locking member but its corresponding length is appreciably longer than the base of the upstanding locking member. The upstanding locking member freely moves within the annular chamber in a back and forth manner.

Disposed on the inner surface of the flat first panel and flat second panel are a plurality of rib means that prevent the first and second panels from being compressed. The ribs function as a spacing means and encourage bending in the E or operational plane and prevent bending in the H plane.

DETAILED DESCRIPTION OF THE PREFERRED EMBODIMENT

Figure 1:
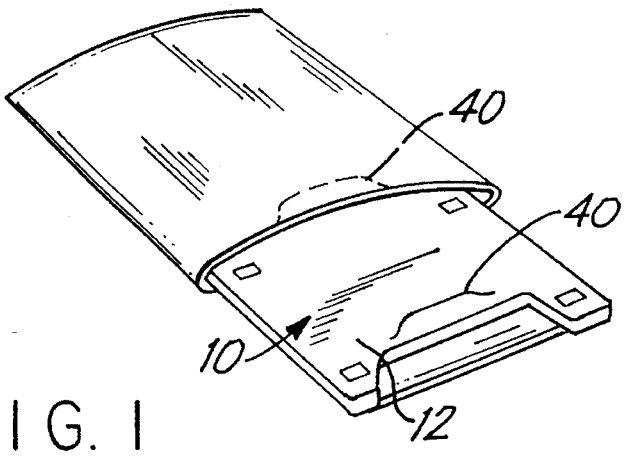
FIG. 1 is perspective view of the envelope package.

Referring with more specificity to the drawings wherein like numerals refer to like parts throughout 10 refers generally to the protective envelope package. FIG. 1 depicts protective envelope package 10 in a folded condition and disposed within a mailer or other envelope of traditional manufacture.

Figure 2:
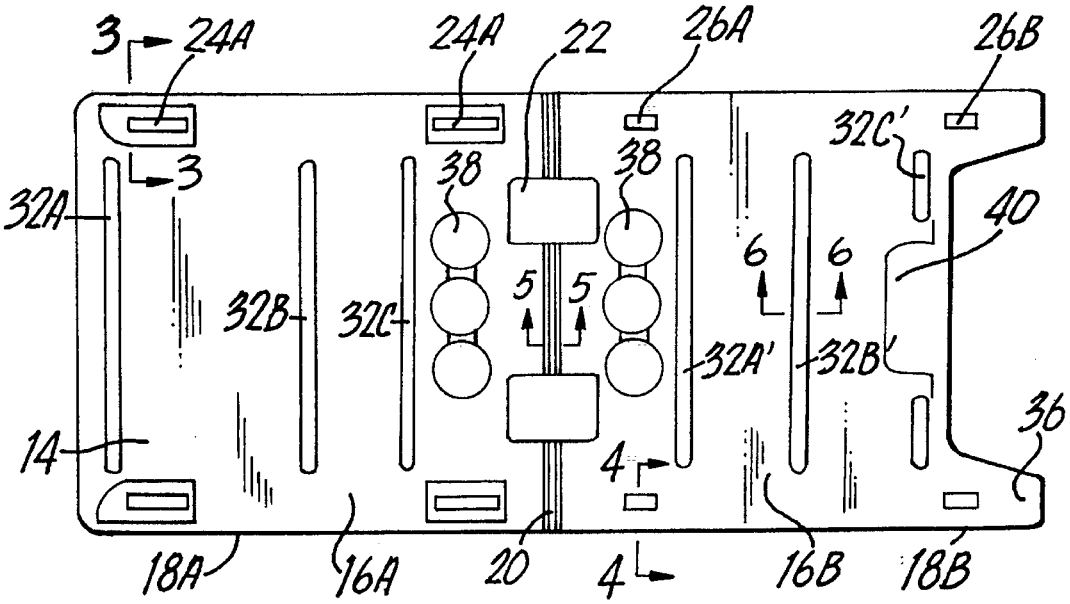
FIG. 2 is a top plan view thereof.
Figure 5:
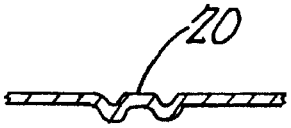
FIG. 5 is a sectional view taken along lines 5—5 of FIG. 1.

Blank 14 which is folded along hinge means 20 provides a flat first panel 16*a* and a flat second panel 16*b*. Hinge means 20, in accordance with FIGS. 2 and 5 show that in the preferred embodiment hinge means 20 is integral and foldedly formed in a W-shaped conformation. Hinge means 20 may, as a preferred embodiment possesses tabular cutouts 22. Cutouts 22 aid in folding protective envelope package 10.

Figure 3:
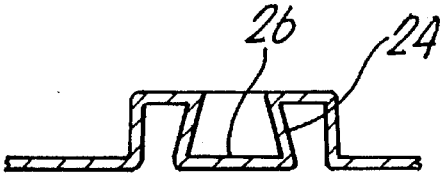
FIG. 3 is a sectional view taken along lines 3—3 of FIG. 1.
Figure 7:
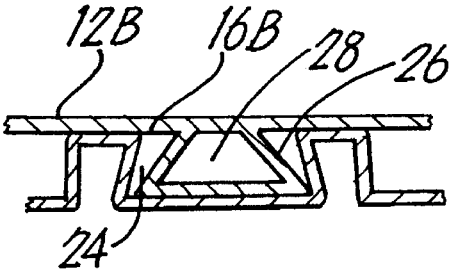
FIG. 7 is a sectional view showing an upstanding locking member seated within an annular receptacle.
Figure 8:
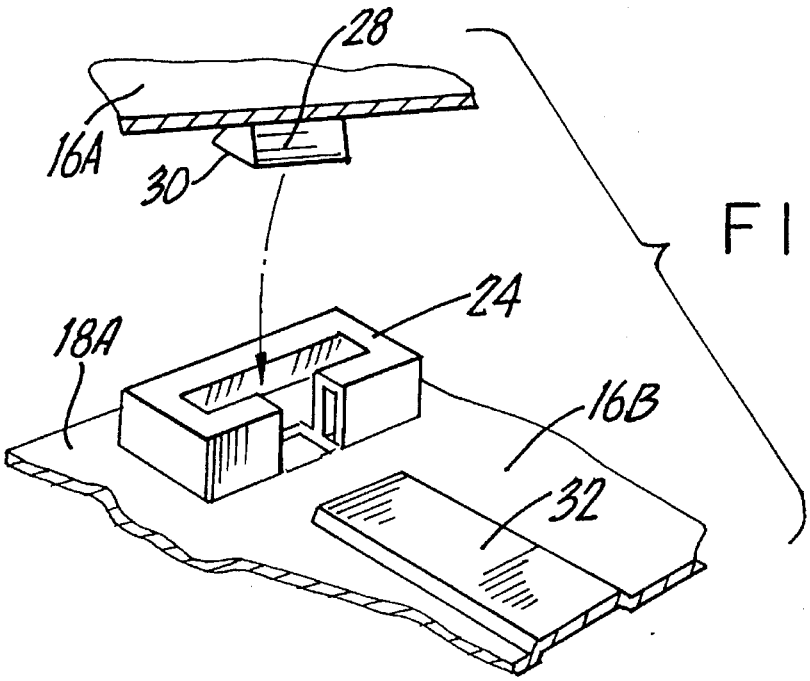
FIG. 8 is a perspective view of showing the method of engagement of an upstanding locking member into an annular receptacle.

Upstanding from flat first panel 16*a* is a plurality of rectilinearly shaped annular receptacles 24*a–b*, 24*a'–b'* disposed along the top and bottom peripheral edge 18*a* of said flat first panel 16*a*. The preferred shape of annular receptacles 24*a'–b* and 24*a'–b'* as illustrated in FIGS. 3, 7 and 8 is such that annular cavity 26 is flared outwardly top to bottom. Shaped as a trapezoid the base of said annular cavity 26 is designed to be from 0.25 inches to 0.55 in length and from 0.08 inches to 0.2 inches in width. Flared outwardly top to bottom, the preferred angle is from 3 degrees to 10 degrees.

Figure 4:
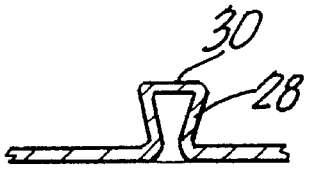
FIG. 4 is a sectional view taken along lines 4—4 of FIG. 1.

Upstanding from flat second panel 16*b* is a plurality of upstanding locking members 28*a–b*, 28*a'–b'* disposed along the top and bottom of peripheral edge 18*b* of said flat second panel 16*b*. The preferred shape of upstanding locking member 28, as depicted in FIGS. 4, 7 and 8 is such that it is similar in geometry to annular cavity 26 and is preferably flared outwardly top to bottom. Shaped as a trapezoid the base of said upstanding locking member 30 approximates the dimensions of cavity 26 and is from 0.25 inches to 0.55 in length and from 0.08 inches to 0.2 inches in width. As a rule, annular cavity 26 is approximately twice the length of base 30 of upstanding locking member 28.

FIG. 8 clearly shows the locking engagement of upstanding locking member 28 being snapped into annular receptacle 24. Once engagement has been effected, upstanding locking member 28 is held within annular receptacle by virtue of its elongated flared base 30, the base area is smaller than the aperture created by the narrowing upward constriction of annular receptacle 24. As shown in FIG. 7 annular receptacle 24 is longer than base 30 of upstanding locking member 28 allowing said upstanding locking member 28 to slide in a forward and back movement or travel path.

Base 30 of upstanding member 28 is flared top to bottom so that its preferred shape is characterized by flaring such that there is a larger base member than top member. Therefore, upstanding locking member 28 can be a conical or curvilinear shape like an inverted mushroom or even pyramidal in nature.

Figure 6:
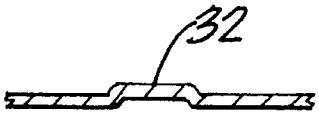
FIG. 6 is a sectional view taken along lines 6—6 of FIG. 1.

As shown in FIG. 2, a plurality of ribs 32*a–c* and 32*a'–c'* which are integral with said flat first panel 14*a* and said flat second panel 14*b* are spaced longitudinally adjacent to one another and are in a parallel configuration thereto. Each rib, as further illustrated in FIG. 6 is not only integral but also of a height which is sufficient to protect the object from forces exerted on the outside of panels 12*a* and 12*b*. Ribs 32*a–c* and 32'–*c*'may abut one another or may be formed to nest one on top of its corresponding other. Hence, rib 32*a* of panel 16*a* would abut or rest on top of rib 32*a'* on panel 16*b*. While preferably ribs 32*a–c* and 32*a'–c'* are integral and continuous they may be separate and bonded or otherwise applied to panel 16*a* and 16*b* by heat fusion or some other method after forming of blank 14.

Figure 11:
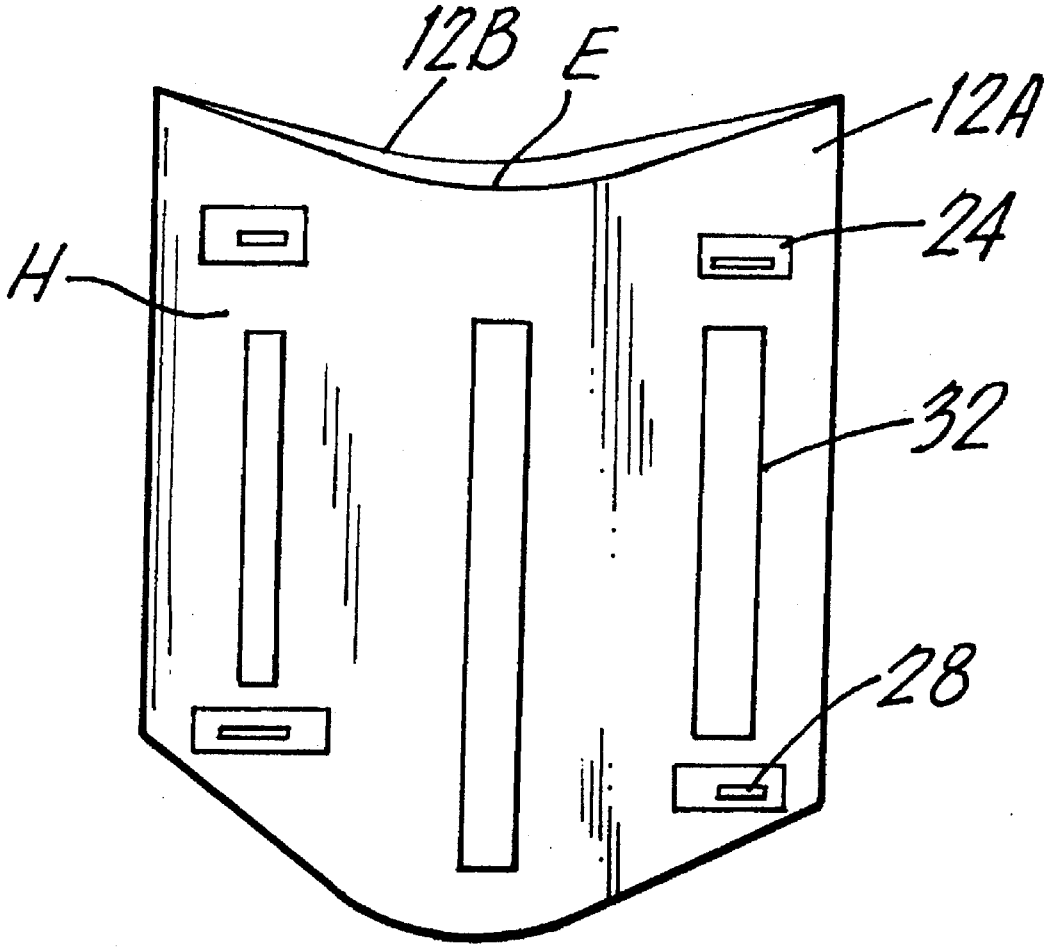
FIG. 11 is an elevational view showing lines of bending.

Ribs 32*a–c* and 32*a'–c'* prevent deformation of the package while encouraging bending. As further illustrated by FIG. 11 ribs 32*a–c* and 32*a*'c' provide stiffness to protective envelope package 10 so that compressive forces which are exerted against the H plane are opposed. In providing stiffness in the perpendicular H plane, longitudinally disposed ribs 32*a–c* and 32*a'–c'* prevent compression but allows envelope package 10 complete freedom to be bent to an angle greater than 180 degrees in the operational or E plane. Therefore, envelope package 10, when disposed within a mailer of traditional design can be assimilated into the postal system equipment while still maintaining integrity in the closed position.

Figure 9:
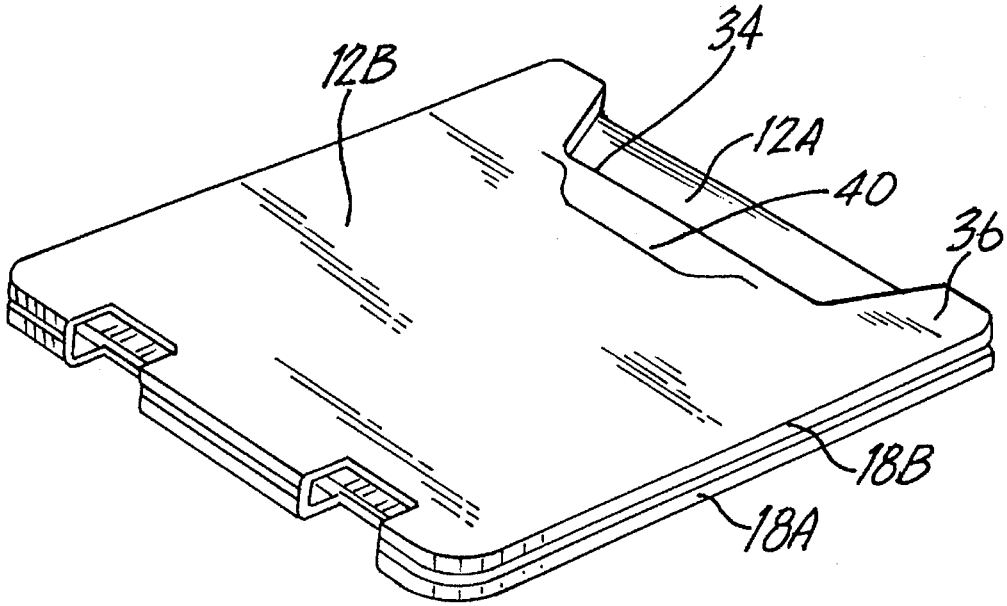
FIG. 9 is an elevated view in perspective showing the envelope package in a folded condition.

In addition, when envelope package 10 is in a folded condition as in FIG. 9, ribs 32*a–c* and 32*a'–c'* and 32*a–c* and 32*a'–c'* create a carrying area where an object can be retained for mailing. The height of said ribs 32*a–c* and 32*a'–c'* and 32*a–c* must be sufficient for the intended purpose. Preferably the height of each rib 32 of ribs 32*a–c* and 32*a'–c'* is from 0.009 inches to 0.250 inches. The width of ribs 32*a–c* and 32*a'–c'* is sufficient to prevent inward deformation of envelope package 10. While the space created by ribs 32*a–c* and 32*a'–c'* may provide a carrying area top reversibly retain an object, an integral blister-shaped 38 area can be formed for carrying the intended object. The depression or blister shaped area 38 can be integrally formed within the inner panels of 16*a* and 16*b*. The resultant are being a single retaining area or abutting areas. By increasing the number and position of ribs 32 a rectangular-shaped area can as an alternative be fashioned to reversibly retain an object for mailing. In the instant invention as represented by FIG. 2 the preferred shape for blister area 38 is peanut-shaped integrally formed.

Ribs 32*a–c* and 32*a'–c'* and annular receptacles 24*a–b* and 24*a'–b'* along with upstanding locking members 28*a–b* and 28*a'–b'* cooperate to prevent envelope package 10 from opening. Ribs 32*a–c* and 32*a'–c'* prevent inward deformation and thus retard up and down movement of upstanding locking members 28*a–c* and 28*a'–c'*. By preventing repeated up and down movement, or compressive movement, the integrity of the engagement between base 30 of upstanding locking members 28 is kept intact thereby resulting in heightened locking strength. A second modality inherent to the preferred design cooperates to insure heightened locking. By fashioning annular cavity 26, of annular receptacle 24, so that it is longer than base 30 of upstanding locking member 28, locking member 28 may slide backwards and forwards. By allowing locking member 28 to slide forward and back, any applied force or untoward stress will move the member in a forward and back direction thereby preventing a sudden upward unlocking movement of upstanding locking member 28 upward and out of annular receptacle 24. If annular cavity 26 is essentially the same size as base 30 of upstanding locking member 28, then an unexpected force could exert a sufficient upward force to open the locked package. Therefore, by allowing the package to move in a sliding manner back and forth, the envelope package may be bent within an angle of 180 degrees without failure of the package's integrity. Ribs 32*a–c* and *a'–c'* are the only contact points which act against panels 16*a* and 16*b*, reducing surface area and thereby decreasing friction yet again reducing the untoward exigency of unexpected opening.

Within panel 16*b* is panel cutout 34, as shown if FIG.2. When in a folded condition as depicted by FIG. 9, panel cutout 34 aligns with and abuts panel 16*a* and provides a purchase for opening envelope package 10. Tab 36 presents a surface for annular receptacle 32*b'* to reside on and provides the most lateral boundary for encouraging package rigidity. Tab 40 within panel 16*b* is adapted to slidingly engage the outer surface of a mailer as in FIG. 1. As an anchor point tab 40 redistributes the force when protective envelope package 10 is opened.

The preferred material for blank 14 is a transparent thermoplastic polymer. For example, such thermoplastic polymers as polyethylene pterepthalate, polyvinylchloride, polycarbonate, polyacrylate, or polyurethane. The preferred polymer is polyethylene pterepthalate glcyol (commonly known as PETG). The blank material is preferably from 0.009 inches to 0.187 inches thick. The polymer should be resistant to extremes in temperature, cracking and should be flexible and with sufficient memory to restore itself to a flat conformation after repeated bending. In fact, the envelope package 10 in accordance with the present invention is capable of repeated bending within an angle of about 180 degrees and returning to its prior flat conformation without opening. As alternate embodiments, chipboard or cardboard, either alone or in combination with a thermoplastic polymer, can be used as a blank material. Further various metals, like steel and composite products can be operatively substituted.

Figure 10:
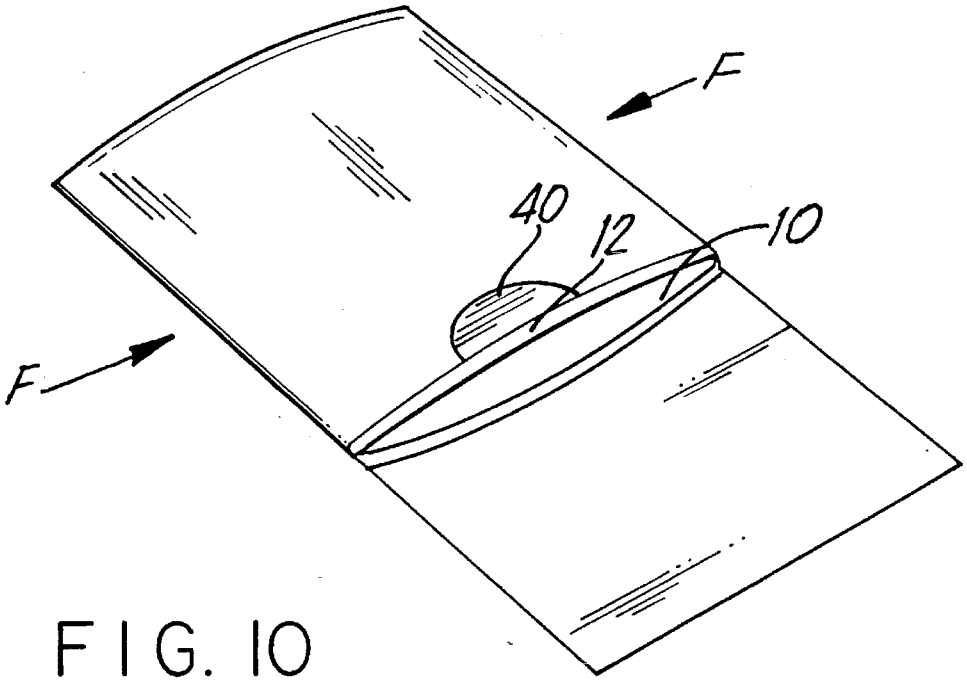
FIG. 10 is an elevational view in perspective showing the envelope package being opened by force exerted by arrows.

A unique aspect of the cooperative implementation found in the opening of envelope package 10 is the interaction of all of the parts to provide opening and ejection of the object without the user actually touching the object. As shown in FIG. 10, when a mailer is opened one merely exerts an inward pressure in accordance with arrows "A". By pushing peripheral edges 18*a* and 18*b* inward, the force creates a bowing out of flat first panel 16*a* and flat second panel 16*b*. Tab 40 which anchors protective envelope 10 to the mailer encourages the inward force to be directed outward. Panel cutout 34 and panel tabs 36 assist in initiating opening by allowing a purchase for slightly opening protective envelope package 10. Ribs 32*a–c* and 32*a'–c'* channel the force outward and support the bow shape by acting as supports. Once opening is initiated, envelope package 10 will automatically open discharging the object retained therein without being manipulated or otherwise touched by a person. Obviously, for objects housing toxic contents or samples where the danger of contamination exists, the envelope package in accordance with the preferred embodiment furnishes an ideal modality.

It is understood by one skilled in the art that many composite and polymeric materials may be substituted, that the general geometric designs may be altered slightly or the various members increased or decreased in both number and size, or that one could divide the panels. The invention therefore is not limited to the foregoing but resides in the inventive concept as it is described by the scope and spirit of the specification and claims which follow.

What we claim is:

1. A protective envelope package comprising:

a. flat blank which is foldable to include;

b. an essentially flat first panel and an essentially flat second panel;

c. a flexible hinge means joining said flat first panel and said flat second panel;

d. a plurality of annular receptacles disposed along the upper and lower peripheral edges of said flat first panel;

e. a like number of upstanding locking members adapted to engage said plurality of annular receptacles maintaining said flat first panel and said flat second panel in a closed condition;

f. a first plurality of ribs spaced adjacent to one another in parallel configuration along the inside surface of said flat first panel; and g. a second plurality ribs spaced adjacent and in parallel configuration along the inside surface of said flat second panel so that said first plurality of ribs and said second plurality of ribs cooperate to prevent deformation and unintentional opening of said protective envelope package.

2. The protective envelope package in accordance with claim 1, wherein said annular receptacles are flared outwardly top to bottom to reversibly accommodate said upstanding locking members.

3. The protective envelope package in accordance with claim 1, wherein said annular receptacles are flared outwardly top to bottom from 3 degrees to 10 degrees to reversibly accommodate said upstanding locking members.

4. The protective envelope package in accordance with claim 1, wherein the length area of said annular receptacles is sufficient to allow said upstanding locking member to move in a forward and back travel path.

5. The protective envelope package in accordance with claim 1, wherein the length area of said annular receptacles is at least twice the length area of the base of said upstanding locking member.

6. The protective envelope package in accordance with claims 1, wherein said upstanding locking members are flared outwardly top to bottom in a trapezoidal shape.

7. The protective envelope package in accordance with claims 1, wherein said first plurality of rib means abut said second plurality of rib means.

8. The protective envelope package in accordance with claims 1, wherein said first plurality of rib means and said second plurality of rib means facilitate flexure in the E plane and retard flexure in the H plane to provide flexure in the operational plane thereby preventing compression.

9. The protective envelope package in accordance with claims 1, wherein the material is chosen from the group consisting of thermoplastic polymers, metal, chip-board, cardboard, and combinations thereof.

10. The protective envelope package in accordance with claims 1, wherein the material is chosen from the group consisting of polyethylene pterepthalate, polyvinylchloride, polycarbonate, polyester polyacrylate, polystyrene, polypropylene or polyurethane.

11. The protective envelope package in accordance with claims 1, wherein the material is polyethylene pterephtalate glycol.

12. The protective envelope package in accordance with claims 1, wherein the blank material is from 0.009 inches to 0.187 inches thick.

13. The protective envelope package in accordance with claims 1, wherein said rib means are of a height sufficient to retain an object within an area defined by adjacent rib means.

14. The protective envelope package in accordance with claims 1, wherein said plurality of rib means are from 0.009 to 0.250 inches in height.

15. The protective envelope package in accordance with claims 1, wherein said area adapted to receive an object is blister-shaped.

16. The protective envelope package in accordance with claims 1, wherein said area adapted to receive an object is peanut-shaped.

17. The protective envelope package in accordance with claims 1, wherein said area adapted to receive an object is further comprised of a plurality of upstanding walls and is rectilinearly-shaped.

18. The protective envelope package in accordance with claims 1, wherein said first flat panel and said second flat panel is adapted to receive an object within a first blister-shaped area within said first flat panel and a second blister-shaped area within said second flat panel.

19. The protective envelope package in accordance with claims 1, wherein said plurality of ribs are integral with said flat panels.

20. The protective envelope package in accordance with claims 1, wherein said plurality of annular receptacles are integral with said flat first panel.

21. The protective envelope package in accordance with claims 1 wherein said upstanding locking members are integral with said flat second panels.

22. The protective envelope package in accordance with claims 1, wherein a plurality of cutouts are spaced within said hinge means to facilitate opening of said protective envelope package.

23. The protective envelope package in accordance with claims 1, having sufficient flexibility to remain in a closed condition after repeated bending to an angle of at least 180 degrees.

24. A protective envelope package comprising:

a. a flat blank panel which is foldable to include;

b. an essentially flat first panel and an essentially flat second panel, said flat first panel and said flat second panel being adapted to receive an object within, when said flat first panel and flat second panels are in a folded condition;

c. a flexible hinge means joining said flat first panel and said flat second panel and allowing said flat first and flat second panel to be maintained in a folded condition;

d. a plurality of annular receptacles disposed along the upper and lower peripheral edges of said flat first panel;

e. a like number of upstanding locking members adapted to engage said plurality of annular receptacles retaining said flat first panel and said flat second panel in a closed condition;

f. a first plurality of ribs spaced adjacent to one another in parallel configuration along the inside surface of said flat first panel;

g. a second plurality of ribs spaced adjacent and in parallel configuration along the inside surface of said flat second panel so that said first plurality of ribs and said second plurality of ribs are of a height sufficient to maintain said object in an immovable condition and to cooperate to prevent deformation and unintentional opening of said protective envelope package; and h. a carrying area to reversibly retain an object.

25. The protective envelope package in accordance with claim 24, wherein said annular receptacles are flared outwardly top to bottom to reversibly accommodate said upstanding locking members.

26. The protective envelope package in accordance with claim 24, wherein said annular receptacles are flared outwardly top to bottom from 3 degrees to 10 degrees to reversibly accommodate said upstanding locking members.

27. The protective envelope package in accordance with claim 24, wherein the length area of said annular receptacles is sufficient to allow said upstanding locking member to move in a forward and back travel path.

28. The protective envelope package in accordance with claim 24, wherein the length area of said annular receptacles is at least twice the length area of the base of said upstanding locking member.

29. The protective envelope package in accordance with claim 24, wherein said upstanding locking members are flared outwardly top to bottom in a trapezoidal shape.

30. The protective envelope package in accordance with claim 24, wherein said first plurality of rib means abut said second plurality of rib means.

31. The protective envelope package in accordance with claim 24, wherein said first plurality of rib means and said second plurality of rib means facilitate flexure in the E plane and retard flexure in the H plane to provide flexure in the operational plane thereby preventing compression.

32. The protective envelope package in accordance with claim 24, wherein the material is chosen from the group consisting of thermoplastic polymers, metal, chip-board, cardboard, and combinations thereof.

33. The protective envelope package in accordance with claim 24, wherein the material is chosen from the group consisting of polyethylene pterepthalate, polyvinylchloride, polycarbonate, polyester polyacrylate, polystyrene, polypropylene or polyurethane.

34. The protective envelope package in accordance with claim 24, wherein the material is polyethylene pterephtalate glycol.

35. The protective envelope package in accordance with claims wherein the blank material is from 0.009 inches to 0.187 inches thick.

36. The protective envelope package in accordance with claims 24, wherein said rib means are of a height sufficient to retain an object within an area defined by adjacent rib means.

37. The protective envelope package in accordance with claim 24, wherein said plurality of rib means are from 0.009 to 0.250 inches in height.

38. The protective envelope package in accordance with claim 24, wherein said area adapted to receive an object is blister-shaped.

39. The protective envelope package in accordance with claim 24, wherein said area adapted to receive an object is peanut-shaped.

40. The protective envelope package in accordance with claim 24, wherein said area adapted to receive an object is further comprised of a plurality of upstanding walls and is rectilinearly-shaped.

41. The protective envelope package in accordance with claim 24, wherein said first flat panel and said second flat panel is adapted to receive an object within a first blister-shaped area within said first flat panel and a second blister-shaped area within said second flat panel.

42. The protective envelope package in accordance with claim wherein said plurality of ribs are integral with said flat panels.

43. The protective envelope package in accordance with claim 24, wherein said plurality of annular receptacles are integral with said flat first panel.

44. The protective envelope package in accordance with claim 24, wherein said upstanding locking members are integral with said flat second panels.

45. The protective envelope package in accordance with claim 24, wherein a plurality of cutouts are spaced within said hinge means to facilitate opening of said protective envelope package.

46. The protective envelope package in accordance with claim 24, having sufficient flexibility to remain in a closed condition after repeated bending to an angle of at least 180 degrees.

47. A protective envelope package comprising:

a. a flat blank panel which is foldable to include;

b. an essentially flat first panel and an essentially flat second panel, said flat first panel and said flat second panel being adapted to receive an object therein, when said flat first panel and flat second panel are in a folded condition;

c. a flexible hinge means joining said flat first panel and said flat second panel, said hinge means being integral and continuous with said flat first panel and said flat second panel, and said flat second panel possessing a cut-out and tab along the edge opposing said hinge means, said cut-out to facilitate opening of said protective envelope package, said tab creating an anchor point to seat said protective envelope package into a mailer;

d. a plurality of annular receptacles disposed along the upper and lower peripheral edges of said flat first panel;

e. a like number of upstanding locking members, wherein the bases of said upstanding locking members are dimensionally smaller than the area of the cavity of said plurality of annular receptacles so that said upstanding locking members can travel in a back and forth movement, said plurality of annular receptacles adapted to engage said like number of upstanding locking members retaining said flat first panel and said flat second panel in a closed condition;

f. a first plurality of ribs spaced adjacent to one another in parallel configuration along the inside surface of said flat first panel for providing stiffness along longitudinal lines;

g. a second plurality of ribs spaced adjacent and in parallel configuration along the inside surface of said flat second panel so that said first plurality of ribs and said second plurality of ribs cooperate to provide stiffness along longitudinal lines and to prevent deformation and unintentional opening of said protective envelope package; and h. a blister-shaped area to retain an object.

48. The protective envelope package in accordance with claim 47, wherein said annular receptacles are flared outwardly top to bottom to reversibly accommodate said upstanding locking members.

49. The protective envelope package in accordance with claim 47, wherein said annular receptacles are flared outwardly top to bottom from 3 degrees to 10 degrees to reversibly accommodate said upstanding locking members.

50. The protective envelope package in accordance with claim 47, wherein the length area of said annular receptacles is sufficient to allow said upstanding locking member to move in a forward and back travel path.

51. The protective envelope package in accordance with claim 47, wherein the length area of said annular receptacles is at least twice the length area of the base of said upstanding locking member.

52. The protective envelope package in accordance with claim 47, wherein said upstanding locking members are flared outwardly top to bottom in a trapezoidal shape.

53. The protective envelope package in accordance with claim 47, wherein said first plurality of rib means abut said second plurality of rib means.

54. The protective envelope package in accordance with claim 47, wherein said first plurality of rib means and said second plurality of rib means facilitate flexure in the E plane and retard flexure in the H plane to provide flexure in the operational plane thereby preventing compression.

55. The protective envelope package in accordance with claim 47, wherein the material is chosen from the group consisting of thermoplastic polymers, metal, chip-board, cardboard, and combinations thereof.

56. The protective envelope package in accordance with claim 47, wherein the material is chosen from the group consisting of polyethylene pterepthalate, polyvinylchloride, polycarbonate, polyester polyacrylate, polystyrene, polypropylene or polyurethane.

57. The protective envelope package in accordance with claim 47, wherein the material is polyethylene pterephtalate glycol.

58. The protective envelope package in accordance with claim 47, wherein the blank material is from 0.009 inches to 0.187 inches thick.

59. The protective envelope package in accordance with claim 47, wherein said rib means are of a height sufficient to retain an object within an area defined by adjacent rib means.

60. The protective envelope package in accordance with claim 47, wherein said plurality of rib means are from 0.009 to 0.250 inches in height.

61. The protective envelope package in accordance with claim 47, wherein said area adapted to receive an object is blister-shaped.

62. The protective envelope package in accordance with claim 47, wherein said area adapted to receive an object is peanut-shaped.

63. The protective envelope package in accordance with claim 47, wherein said area adapted to receive an object is further comprised of a plurality of upstanding walls and is rectilinearly-shaped.

64. The protective envelope package in accordance with claim 47, wherein said first flat panel and said second flat panel is adapted to receive an object within a first blister-shaped area within said first flat panel and a second blister-shaped area within said second flat panel.

65. The protective envelope package in accordance with claim 47, wherein said plurality of ribs are integral with said flat panels.

66. The protective envelope package in accordance with claim 47, wherein said plurality of annular receptacles are integral with said flat first panel.

67. The protective envelope package in accordance with claim 47, wherein said upstanding locking members are integral with said flat second panels.

68. The protective envelope package in accordance with claim 47, wherein a plurality of cutouts are spaced within said hinge means to facilitate opening of said protective envelope package.

69. The protective envelope package in accordance with claim 47, having sufficient flexibility to remain in a closed condition after repeated bending to an angle of at least 180 degrees.

* * * * *